United States Patent [19]

Murakami et al.

[11] Patent Number: 4,947,217

[45] Date of Patent: Aug. 7, 1990

[54] IMAGE FORMING APPARATUS WITH CONTROL MECHANISM TO CORRECT ANY ABBERATION IN STOPPING POSITION OF ORIGINAL DOCUMENT

[75] Inventors: Koichi Murakami, Yokohama; Takeshi Honjo, Kawasaki, both of Japan

[73] Assignee: Canon Kabushiki Kaisha, Tokyo, Japan

[21] Appl. No.: 260,570

[22] Filed: Oct. 21, 1988

[30] Foreign Application Priority Data

Oct. 29, 1987 [JP] Japan ..... 62-271833

[51] Int. Cl.[5] ..... G03G 21/00

[52] U.S. Cl. ..... 355/317; 355/208; 355/316

[58] Field of Search ..... 355/230, 231, 75, 317, 355/316, 208, 218; 271/226, 227, 228, 233

[56] References Cited

U.S. PATENT DOCUMENTS

| | | | |
|---|---|---|---|
| 4,310,236 | 1/1982 | Connin | 271/227 X |
| 4,350,439 | 9/1982 | Tanioka et al. | 271/227 X |
| 4,519,700 | 5/1985 | Barker et al. | 271/226 X |
| 4,579,444 | 4/1986 | Pinckney et al. | 355/317 |

FOREIGN PATENT DOCUMENTS

| | | | |
|---|---|---|---|
| 55-52072 | 4/1980 | Japan | 355/75 |
| 62-24275 | 2/1987 | Japan | 355/75 |

*Primary Examiner*—A. T. Grimley
*Assistant Examiner*—Robert Beatty
*Attorney, Agent, or Firm*—Fitzpatrick, Cella, Harper & Scinto

[57] ABSTRACT

There is disclosed an image forming apparatus with a document handling device. In order to prevent eventual aberration in the stopping position of the document, the apparatus of the present invention measures the amount of abberation in the stopping position of the document and accordingly controls the image forming position.

9 Claims, 5 Drawing Sheets

IMAGE FORMING APPARATUS WITH CONTROL MECHANISM TO CORRECT ANY ABBERATION IN STOPPING POSITION OF ORIGINAL DOCUMENT

BACKGROUND OF THE INVENTION

1. Field of the Invention

The present invention relates to an image forming apparatus with a document handling device for feeding original documents to a predetermined position.

2. Related Background Art

Among image forming apparatus such as copying machines, the use of document handling devices for feeding original documents to a predetermined position such as an exposure position, has been increasing for the purpose of alleviating the cumbersome handling of the original documents by the operator.

However, in case of feeding an original document to a predetermined position, the positional accuracy of stopping the original documents is very important. If the stopped position deviates from a predetermined position, the electrostatic latent image of a recording medium will also be deviated, thus causing a displacement of the reproduced image on the recording sheet.

For this reason, in order to stop the original document at a predetermined position, there have been proposed, for example;

(a) to provide a retractable stopper at a predetermined position and to stop the document in abutting relation therewith (U.S. Pat. No. 4,268,870); and (b) to count the pulses from an encoder, mounted on a document feeding motor, from a predetermined preparatory position of the document, and to stop said motor upon counting a predetermined number of pulses (U.S. Pat. No. 4,667,951, U.S. Ser No. 016,867 filed on Feb. 20, 1987 and U.S. Ser. No. 049,970 filed on May 15, 1987).

However the above-mentioned method (a) is complex in structure and expensive. Also it is not suitable for high-speed operation, since very thin documents may be bent at the stopped position.

On the other hand, in the method (b), the braking of the feeding motor can be achieved by electrical connection of both ends of said motor and/or combination of a magnetic brake with said motor, but certain error in the stopping position is unavoidable due to variation in load, time-dependent change in performance, inertia etc. For reducing such influences, the feeding speed may be lowered before braking, but such solution inevitably decreases the exchanging speed of the documents.

SUMMARY OF THE INVENTION

In consideration of the foregoing, an object of the present invention is to provide an improved image forming apparatus.

Another object of the present invention is to provide an image forming apparatus capable of preventing error in the image position owing to error in the position of the original document.

Still another object of the present invention is to provide an image forming apparatus not causing error in the image position, in case of image formation with a document handling device.

Still another object of the present invention is to provide an image forming apparatus capable of exact image registration without lowering the document feeding speed.

Still another object of the present invention is to provide an image forming apparatus capable of exact image registration without addition of complex mechanisms.

Still another object of the present invention is to provide an image forming apparatus of high reliability and high productivity.

The foregoing and still other objects of the present invention will become fully apparent from the following description, to be taken in conjunction with the attached drawings.

DETAILED DESCRIPTION OF THE PREFERRED EMBODIMENTS

Figure 1:
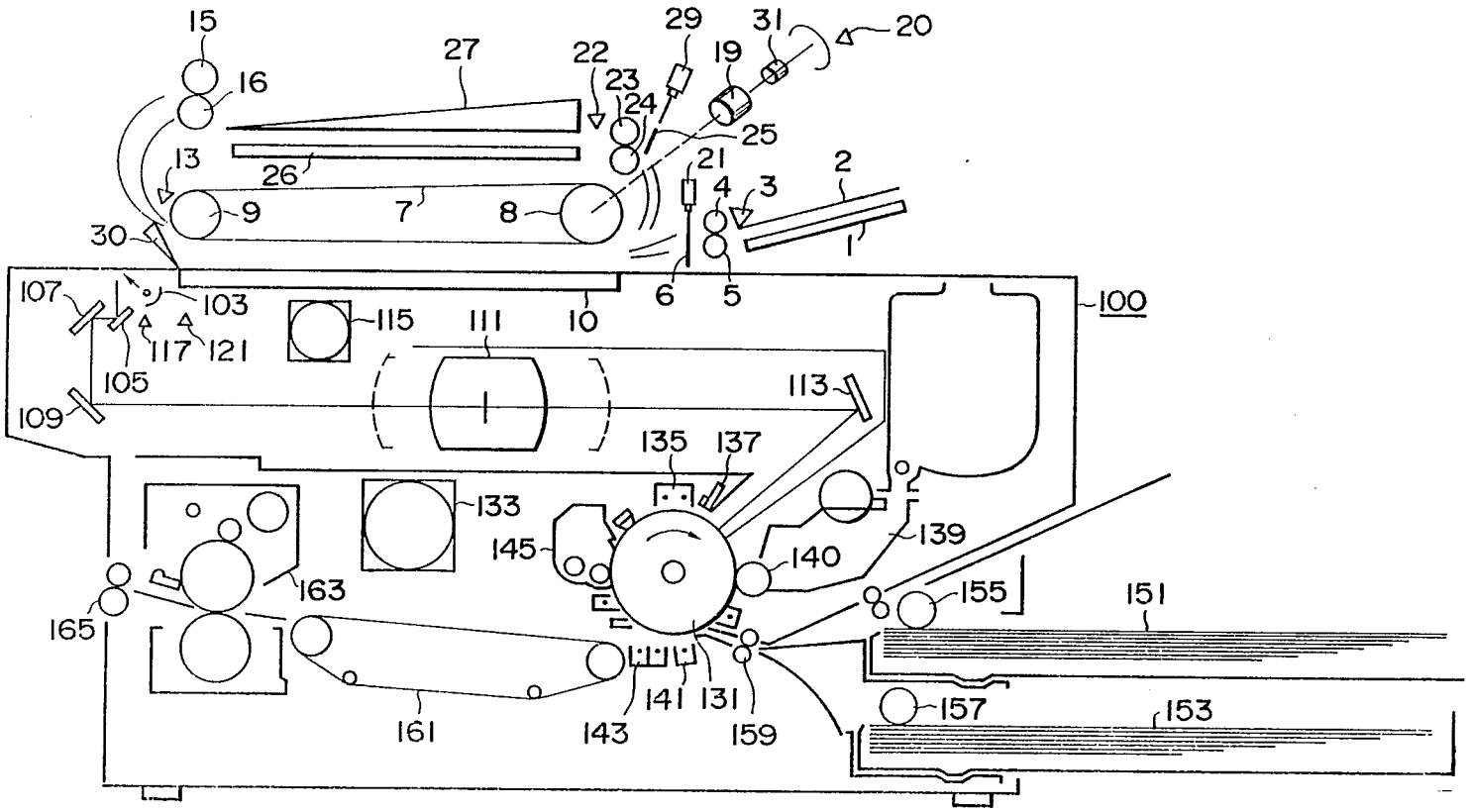
FIG. 1 is a schematic view of a copying apparatus embodying the present invention.

Now the present invention will be clarified in detail by an embodiment thereof shown in the attached drawings. FIG. 1 is a schematic view of a copying apparatus, including a document handling device or a document feeder, and constituting an embodiment of the present invention. In FIG. 1, an inlet tray 1 supports original sheet documents 2 stacked thereon, with the image bearing faces downwards. A first inlet sensor 3 of the document feeder is composed of a reflective sensor, for detecting the leading and trailing end of the sheet document. Transport rollers 4, 5 are maintained in mutual pressure contact for transporting the sheet document therebetween. A stopper 6 for prohibiting the feeding of the document onto an original support glass (platen glass) 10 is retracted by an inlet stopper solenoid 21 to enable said feeding. An endless belt 7, of a width for covering the entire sheet document, has a friction coefficient on the surface sufficient for transporting the document with the frictional force along the glass 10, and is supported between a driving roller 8 and an idler roller 9 in such a manner that no slippage occurs between the belt 7 and the driving roller 8. A discharge flapper 30 is provided for guiding the original document discharged from the support glass 10. An outlet sensor 13 is provided for detecting the original document. The belt 7 is stopped and reversed when the front end of the document is detected by said sensor, and is stopped at a predetermined position when the rear end of the document is detected.

On the document feeder of the present invention there is provided a known digitizer 26 with a digitizer cover 27 disposed in such a manner as to cover the entire digitizer. At the upper right portion of said document feeder there is provided a digitizer sheet inlet for transporting the original document on said digitizer, said inlet being hidden when said cover is closed, but becoming visible when said cover is opened. At said inlet there is provided a digitizer inlet sensor 22, composed of a reflective sensor, for detecting the document placed on the digitizer. Transport rollers 23, 24, maintained in mutual pressure contact, transport the sheet document therebetween. A stopper 25 for prohibiting the feeding of the original document from said inlet to the platen glass, is retracted by a digitizer inlet stopper solenoid 29 for enabling said feeding. The original document transported from said inlet by means of the transport rollers 23, 24 is advanced along guide members and fed onto the platen glass 10 from the right-hand end of the aforementioned belt 7.

All the above-mentioned rollers and belt are driven by a motor 19, provided with a clock disk and a sensor 20 for generating clock pulses in synchronization with the rotation of said motor, and said clock pulses are used for controlling the function of the document feeder. After the completion of an exposure operation, the original document discharged by the belt 7, is inverted by a discharge flapper 30, discharged by mutually contacting discharge rollers 15, 16 and stacked in succession on said digitizer cover.

In the main body 100, there are provided an illuminating (exposure) lamp 103 for illuminating the original document; scanning mirrors 105, 107, 109 for deflecting the light path of the light reflected from the document; a lens 111 for imaging and for varying the image magnification; a fourth scanning mirror 113 for deflecting the light path; an optical system motor 115 for driving the optical system; and sensors 117, 121 for detecting the optical system.

There are further provided a photosensitive drum 131; a main motor 133 for driving the photosensitive drum 131; a high voltage unit 135; a blank exposure unit 137; a developing unit 139; a developing roller 140; a transfer charger 141; a separating charger 143; and a cleaning unit 145.

There are further provided an upper cassette 151; a lower cassette 153; sheet feeding rollers 155, 157; registration rollers 159; a conveyor belt 161 for transporting the recording sheet, after image recording, to a fixing unit; and a fixing unit 163 for fixing the image of thus transported recording sheet by heat and pressure.

The above-mentioned photosensitive drum 131 is composed, at the external periphery thereof, of a seamless photosensitive member consisting of a photoconductive member and a conductive member, said photosensitive drum 131 is rotatably supported, and starts rotation in a direction indicated by an arrow, by the main motor 133 in response to the actuation by a copy start key to be explained later. After predetermined pre-rotation control and potential control of the drum 131, the original document placed on the platen glass 10 is illuminated by the lamp 103 constructed integrally with the first scanning mirror 105, and the light reflected from said document is guided through the first scanning mirror 105, second scanning mirror 107, third scanning mirror 109, lens 111 and fourth scanning mirror 113, and is focused onto the drum 131.

The drum 131 is corona charged by the high voltage unit 135, and is then subjected to slit exposure of the imagewise light reflected from the original document illuminated by the lamp 103 to form an electrostatic latent image through a known electrophotographic process on the drum 131.

The electrostatic latent image on the photosensitive drum 131 is then developed by the developing roller 140 of the developing unit 139 into a visible toner image, which is transferred, as will be explained later, onto a recording sheet by means of the transfer charger 141.

The recording sheet contained in the upper cassette 151 or the lower cassette 153 is fed into the main body by the feed roller 155 or 157, and advances towards the photosensitive drum 131 with an exact timing by the registration rollers 159 in such a manner that the front end of the image on the photosensitive drum 131 coincides with the front end of the recording sheet. Then, the toner image on the drum 131 is transferred onto the sheet while it passes between said drum 131 and the transfer charger 141. After said image transfer, the sheet is separated from the drum 131 by means of the separating charger 143, then guided by the conveyor belt 161 to the fixing unit 163 and subjected to the fixation of the toner image by pressure and heat therein. Subsequently the recording sheet is discharged by the discharge rollers 165 from the main body 100.

After the image transfer, the drum 131 continues to rotate, and is subjected to surface cleaning by the cleaning unit 145 composed of a cleaning roller and an elastic blade.

Figure 2A:
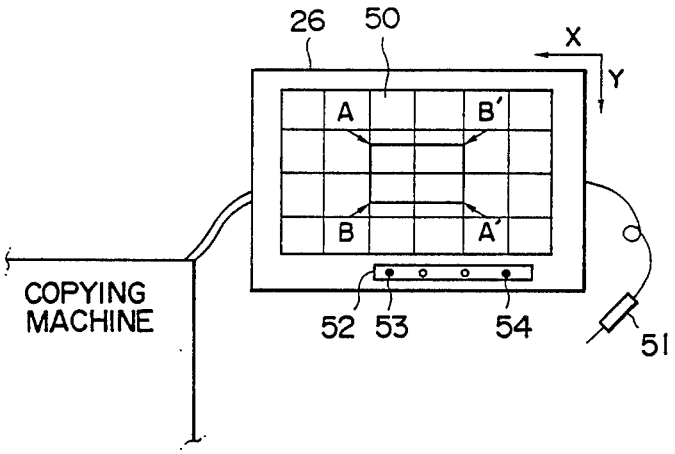
FIGS. 2A and 2B are schematic views of a digitizer.

FIG. 2A is a schematic view of the digitizer, which is composed of a sheet-shaped resistor 50 for reading the horizontal (X) direction and vertical (Y) direction, and a lead pen switch 51. Said sheet-shaped resistor 50 is not only present under a sheet on which the original document is to be placed but also is extended under a clear key 52, a registration key 53 and a continuous mode key 54. Thus a voltage is generated in response to the position of the pen switch and is read as an area setting value or a key input.

Figure 2B:
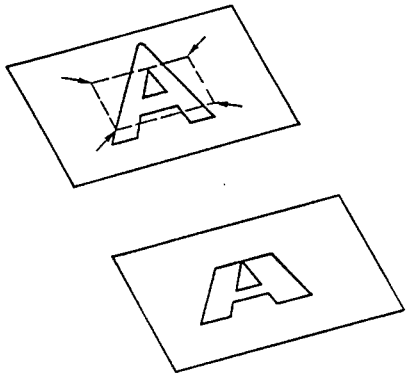

The operator places an original document, with the top face thereof upwards on the resistor 50, at the upper right corner thereof, and depresses two diagonal corners of an area to be selected, for example A and A', or B and B' to designate said area. Then the registration key 53 is depressed with the pen switch to set said area designation. Thus a trimming function or an image converting function is activated at the copying operation, thereby providing a copy as shown in FIG. 2B.

The matching of the recording sheet and the image becomes particularly important in case of using a document feeder equipped with a digitizer as explained above, and the present invention becomes particularly effective in such case.

Figure 3:
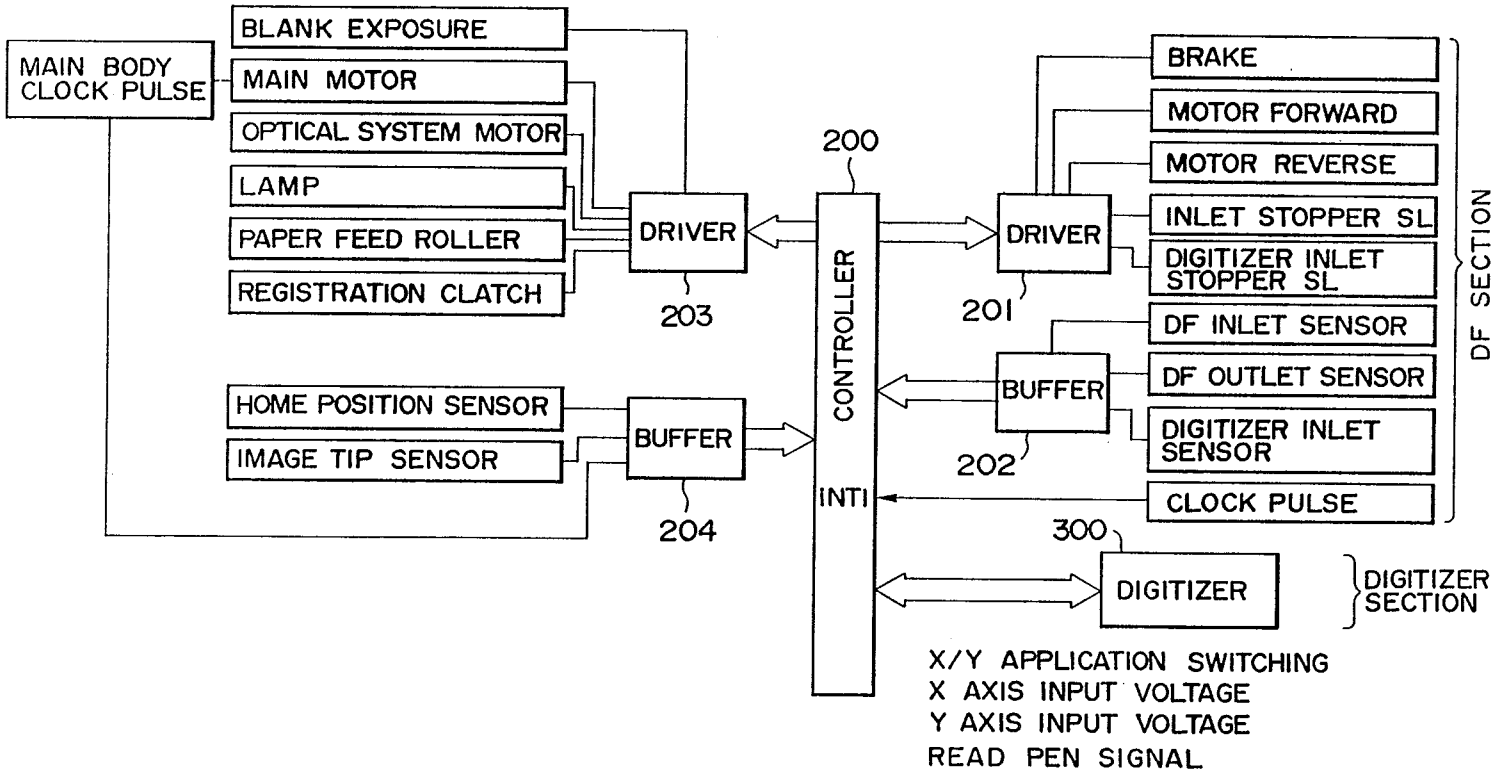
FIG. 3 is a block diagram of the control unit of said embodiment.

FIG. 3 is a block diagram of the control unit of the present embodiment, wherein a controller 200 is composed of a known microcomputer provided with CPU, ROM, RAM, I/0 port etc. The CPU makes access to the RAM and I/0 port according to a program (for example corresponding to the control sequence shown in FIG. 4) stored in the ROM. The document feeder is given, through a driver 201, forward and reverse driving signals for the motor, and on/off signals for the document feeder inlet stopper, digitizer inlet stopper and brake. It supplies input signals from the aforementioned sensors, namely those from the document feeder inlet sensor, document feeder outlet sensor and digitizer inlet sensor, through the buffer 202. It also supplies the interruption port INTI of the controller 200 with clock pulses from the sensor 20. The digitizer 300 is given an X/Y application switch signal, for selecting voltage application to X-axis at the "H"-level or to Y-axis at the "L"-level. It also releases, as input signals, a lead pen signal which is activated when the electrode face of the digitizer is depressed with the lead pen, and an analog X-axis input voltage signal and an analog Y-axis input voltage signal, which represent the depressed position. The various units of the copying machine are given output signals, such as a forward/ reverse drive signal for the optical system motor, a main motor drive signal, a lamp control signal, a sheet feed roller control signal, a registration clutch signal for activating the registration rollers for the timing control of the sheet transportation etc., through a driver 203, and releases, through a buffer 204, signals from an optical system home position sensor 117, and from an image front end sensor 121 for detecting the timing of the registration rollers, and main body clock pulses generated according to the rotation angle of the main motor.

In the following there will be explained the function of the present embodiment, with reference to a timing chart shown in FIG. 4.

Figure 4A:
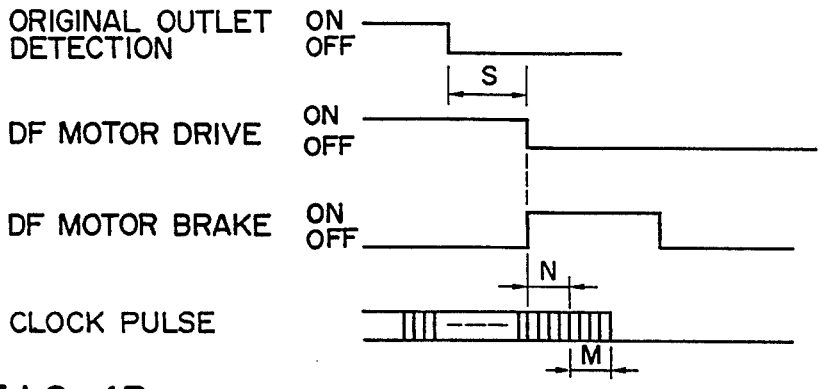
FIGS. 4A to 4C are timing charts showing the function of said embodiment.

When the document feeder outlet sensor 13 detects the front end of the document, the power supply to the document feeder motor 19 is turned off after the counting of clock pulses of a predetermined number S, and braking is simultaneously applied to terminate the transportation of the document. However, because of the inertia and the fluctuation in loads, the document does not stop instantly at the braking, but generally stops after certain rotation of the document feeder motor 19 corresponding to N clock pulses. FIG. 4A shows a situation of a further increase of M clock pulse until the document is stopped. Thus the document is aberrated from the predetermined position by a distance corresponding to M clock pulses. In FIG. 1, the original is in a position which is aberrated to the right, corresponding to M clock pulses.

Figure 4B:
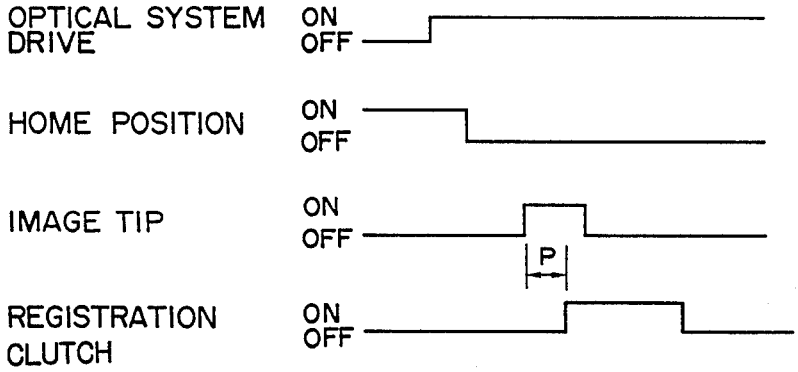
Figure 4C:
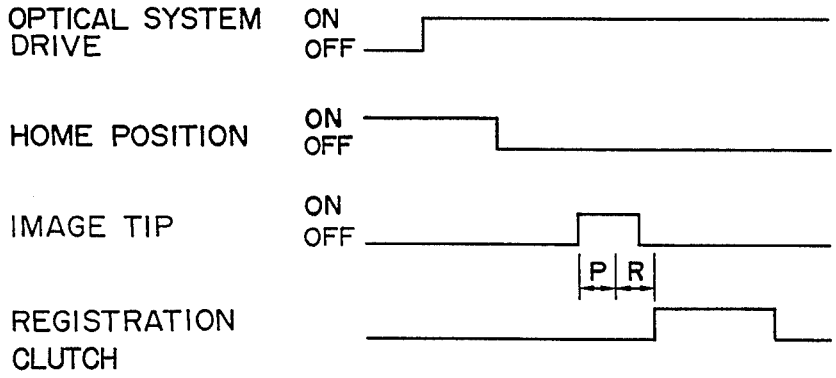

FIGS. 4B and 4C show the timing control of registration of the recording sheet in the copying machine. FIG. 4B shows a situation of $M=0$ in FIG. 4A, namely when the document feeder motor is stopped exactly at the predetermined position, while FIG. 4C shows a situation $M>0$. At first in case of FIG. 4B, after the feeding and stopping of the original document, the optical system driving motor is turned on. After passing of the optical system through the home position sensor 117, when the image front end signal is detected by the image front end sensor 121, the main body clock pulses generated in response to the rotation of the main motor 133 are counted by a number P corresponding to the aforementioned N clock pulses, and the registration clutch is energized. In this manner the recording sheet is exactly registered with the image on the drum, and, after the image transfer and the image fixation, is discharged from the apparatus.

In case of FIG. 4C, the registration clutch is energized after the counting of main body clock pulses by a number of $P+R$, corresponding to the $N+M$ clock pulses. Said number R is to compensate for the aforementioned increase of M clock pulses from the document feeder motor, and this signifies that an error in the document position corresponding to an increase of M clock pulses corresponds, on the drum, to an increase of R clock pulses of the main motor. A clock interval, of the clock pulses of the document feeder motor or the main motor usually corresponds to a distance of 0.2 to 0.8 mm. The foregoing explanation is limited to the case of $M>0$, but a case of $M<0$, namely a case in which the document feeder clock pulses disappear before reaching the count N, can be similarly handled by using a count $P-R$ for the main body clock pulses for controlling the registration clutch.

Figure 5:
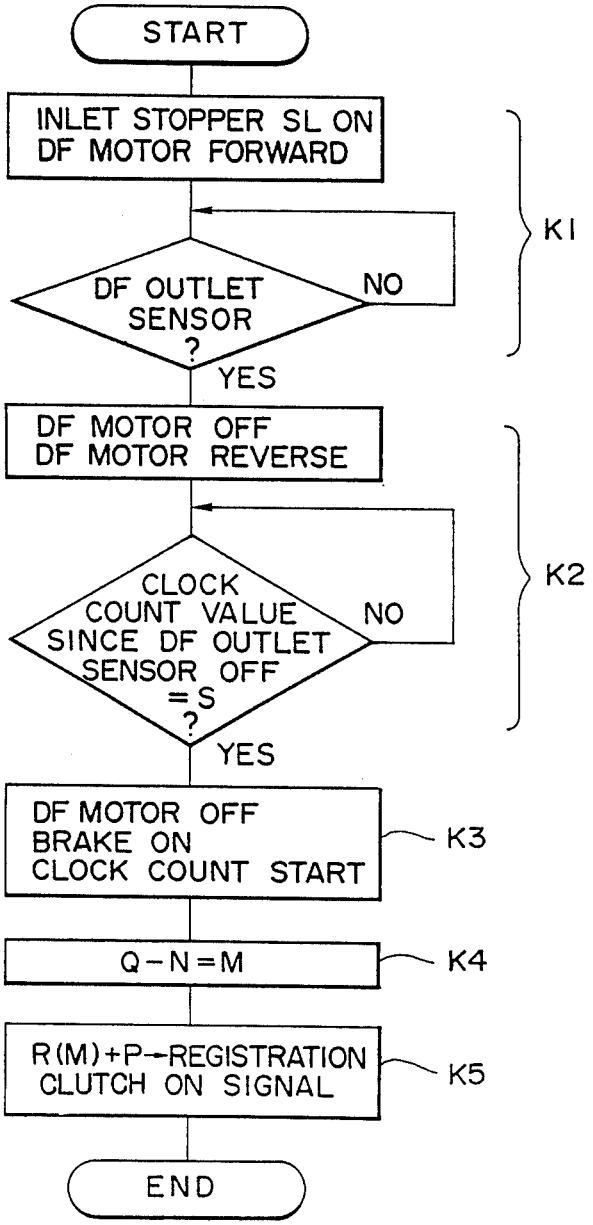
FIG. 5 is a flow chart showing the control sequence of said embodiment

In the following the present invention will be further clarified, with reference to a flow chart shown in FIG. 5, representing the sequence of the above-explained control. When the document is detected by the inlet sensor 3 or 22 and the copy start instruction is given, there is executed a step K1 for energizing the inlet stopper solenoid 21 or 29, rotating the document feeder motor 19 in the forward direction to transport the document, and continuing inspection until the document reaches the document feeder outlet sensor 13. Upon arrival at said outlet sensor 13, a step K2 is executed to turn off the document feeder motor 19, then to start reverse rotation of said motor 19, and to start the counting of the clock pulses from the sensor 20 after the document passes through the document feeder outlet sensor 13. When a count S is reached, the sequence proceeds to a step K3 for turning off the document feeder motor 19 and applying brake to completely stop the belt of the document feeder, and simultaneously counting the clock pulses from the sensor 20 after the document feeder motor 19 is turned off. This counting is for absorbing the error in the stopping position, resulting from fluctuation in the inertia or time-dependent change of the apparatus.

Then a step K4 subtracts a predetermined standard value N from the number Q of clock pulses until the clock pulses completely stop, to obtain the result M, which can be a positive or negative integer.

A next step K5 adds a number R of the main body clock pulses corresponding to M, to a number P of the clock pulses corresponding to the timing of energizing the registration clutch, thereby producing the actual signal for energizing the registration clutch. Said number R assumes a positive or negative value respectively if M is positive or negative.

In the foregoing embodiment, the correcting control for the registration clutch is based on the clock pulses of the main motor of the main body, but it may also be achieved by a variable timer prepared in the CPU of the controller.

The present invention is not limited to the foregoing embodiment, but is subject to various modifications within the scope and spirit of the appended claims.

We claim:

1. An image forming apparatus comprising:

original document feeder means for feeding an original document to a predetermined position and for stopping the same thereat;

signal generator means for generating pulse signals periodically in synchronism with the feeding of the original document;

counter means for counting the number of pulse signals generated from said signal generator means during a period of time from occurrence of an instruction for an operation stop of said original document feeder means to an actual operation stop thereof;

image forming means for forming an image of the original document on a recording material; and control means for controlling said image forming means in accordance with a counting value of said counter means so as to control the position of the image to be formed on said recording material.

2. An image forming apparatus according to claim 1, wherein said control means is adapted to control the timing of feeding of said recording material in accordance with the counting value of said counter means.

3. An image forming apparatus according to claim 2, wherein said image forming means is adapted to form an electrostatic latent image on a photosensitive member, then developing said latent image and transferring thus developed image onto the recording material, and said control means is adapted to control the timing of registration between the image on said photosensitive member and the recording material.

4. An image forming apparatus according to claim 3, wherein said image forming means comprises signal generator means for generating pulse signals periodically in synchronization with the rotation of said photosensitive member, and said control means is adapted to control said timing of registration based on the pulse signals generated by said signal generator means.

5. An image forming apparatus comprising:

designating means for designating a desired area on an original document;

original document feeder means for feeding the original document to a predetermined position and for stopping the same thereat;

signal generator means for generating pulse signals periodically in synchronism with the feeding of the original document;

counter means for counting the number of pulse signals generated from said signal generator means during a period of time for occurrence of an instruction for an operation stop of said original document feeder means to an actual operation stop thereof;

image forming means for forming on a recording material an image of the original document according to the area designated by said designating means; and control means for controlling said image forming means in accordance with a counting value of said counter means so as to control the position of the image to be formed on said recording material.

6. An image forming apparatus according to claim 5, wherein said control means is adapted to control the timing of feeding of said recording material in accordance with the counting value of said counter means.

7. An image forming apparatus according to claim 6, wherein said image forming means is adapted to form an electrostatic latent image on a photosensitive member, then developing said latent image and transferring thus developed image onto the recording material, and said control means is adapted to control the timing of registration between the image on said photosensitive member and the recording material.

8. An image forming apparatus according to claim 7, wherein said image forming means comprises signal generator means for generating pulse signals periodically in synchronization with the rotation of said photosensitive member, and said control means is adapted to control said timing of registration based on the pulse signals generated by said signal generator means.

9. An image forming apparatus according to claim 5, wherein said designating means is provided on the upper part of said original feeder means.

* * * * *

UNITED STATES PATENT AND TRADEMARK OFFICE

CERTIFICATE OF CORRECTION

PATENT NO. : 4,947,217

DATED : August 7, 1990

INVENTOR(S) : Murakami, et al.

It is certified that error appears in the above-identified patent and that said Letters Patent is hereby corrected as shown below:

ON THE TITLE PAGE:

[54] IN THE TITLE,
Line 3, change "ABBERATION" to --ABERRATION--.

[57] ABSTRACT,
Line 5, change "abberation" to --aberration--.

[Sheet 3 of 5] FIGURE 3,
Change "REGISTRATION CLATCH" to --REGISTRATION CLUTCH--.

Column 4,
Line 57, change "interruption port INTI" to --interruption port iNTI-.

Column 7,
Line 23, change "for" to --from--.

Signed and Sealed this

Seventh Day of April, 1992

*Attest:*

HARRY F. MANBECK, JR.

*Attesting Officer*

*Commissioner of Patents and Trademarks*